US005988808A

United States Patent [19]

Jones

[11] Patent Number: 5,988,808

[45] Date of Patent: Nov. 23, 1999

[54] INTERMEDIATE TRANSFER SURFACE SUPPLY SYSTEM

[75] Inventor: Brent R. Jones, Tualatin, Oreg.

[73] Assignee: Tektronix, Inc., Wilsonville, Oreg.

[21] Appl. No.: 08/845,551

[22] Filed: Apr. 24, 1997

[51] Int. Cl.[6] ..... B41J 2/01

[52] U.S. Cl. ..... 347/103; 347/84

[58] Field of Search ..... 347/103, 84, 85, 347/86

[56] References Cited

U.S. PATENT DOCUMENTS

| | | | |
|---|---|---|---|
| 3,968,770 | 7/1976 | Marrs | 118/227 |
| 4,158,498 | 6/1979 | Ohmori | 355/15 |
| 4,400,079 | 8/1983 | Landa | 355/10 |
| 4,538,156 | 8/1985 | Durkee et al. | 346/21 |
| 4,673,303 | 6/1987 | Sansone et al. | 400/126 |
| 4,970,533 | 11/1990 | Saito et al. | 347/86 |
| 5,019,868 | 5/1991 | Kubert et al. | 355/264 |
| 5,099,256 | 3/1992 | Anderson | 346/1.1 |
| 5,389,958 | 2/1995 | Bui et al. | 347/103 |
| 5,808,645 | 9/1998 | Reeves et al. | 347/103 |

FOREIGN PATENT DOCUMENTS

| | | | |
|---|---|---|---|
| 0583168 | 12/1993 | European Pat. Off. . | |
| 7512307 | 12/1975 | Netherlands | 355/297 |

*Primary Examiner*—N. Le
*Assistant Examiner*—Shih-Wen Hsieh
*Attorney, Agent, or Firm*—Charles F. Moore

[57] ABSTRACT

A supply system for supplying liquid to an applicator assembly in an imaging apparatus is provided. The supply system includes a liquid retaining reservoir that is in fluid communication with an applicator assembly. The reservoir utilizes a collapsible bellows construction to contain maximum volume in minimal space. A moveable contact surface selectively contacts and squeezes the reservoir to speed flow of the liquid to the applicator assembly.

16 Claims, 7 Drawing Sheets

INTERMEDIATE TRANSFER SURFACE SUPPLY SYSTEM

FIELD OF INVENTION

The present invention relates generally to an imaging process. More specifically, this invention relates to an improved liquid supply system for use in a printer that applies a liquid intermediate transfer surface to the supporting surface of a transfer drum.

BACKGROUND OF THE INVENTION

Ink-jet printing systems have utilized intermediate transfer surfaces, such as that disclosed in U.S. Pat. No. 5,389,958 for IMAGING PROCESS, assigned to the assignee of the present application. This patent discloses a system wherein an intermediate transfer drum is employed with a print head. A final receiving surface such as paper is brought into contact with a liquid intermediate transfer surface on the intermediate transfer drum after an ink image has been placed thereon by the nozzles in the print head. The image is then transferred to the final receiving surface. The intermediate transfer surface is cleaned and reapplied prior to the next image being formed on the transfer surface.

Imaging systems using a liquid intermediate transfer surface require some sort of applicator assembly for applying and metering the fluid onto the transfer drum support surface. One such applicator assembly is disclosed is copending U.S. patent application Ser. No. 08/382,453, assigned to the assignee of the present application. This application discloses an applicator assembly that is housed in a replaceable transfer drum maintenance cartridge. The applicator assembly uses a liquid impregnated wick as a contact medium to apply the liquid onto the transfer drum support surface and to remove foreign matter from the support surface. The liquid is stored in a reservoir adjacent to the applicator assembly. The release of the liquid from the reservoir is actuated by the movement of the wick assembly upwardly along a valve opening track as the wick assembly moves toward the transfer drum support surface. The applicator assembly includes a hydrodynamic wiper blade that uniformly meters and distributes the liquid intermediate transfer surface over the support surface and incorporates a dam to contain and distribute a sufficient amount of liquid onto the support surface.

While the applicator assembly described in the above application performs well when used in conjunction with printers printing on A-size media (8.5 in.×11.0 in.; 21.59 cm.×27.94 cm.), it is not as well suited for use in B-size (11.0×17.0 in.; 21.59 cm.×27.94 cm.) and larger printers. The larger surface area of the media handled by these printers requires a correspondingly larger amount of liquid to create the intermediate transfer surface. Accordingly, the volummetric capacity of the reservoir containing the liquid must increase, as well as the surface area of the wick that applies the liquid.

As explained in the above-referenced copending application, prior to installation of the drum maintenance cartridge in a printer, the liquid is securely contained in the reservoir and does not flow to the wick in the applicator assembly. Upon insertion of the cartridge into a printer, a valve is opened and the liquid begins flowing to the wick. To allow the wick to become sufficiently saturated with the liquid for proper operation, printing is disabled for a predetermined period after a new cartridge is installed in a printer. This delay, or "time-to-first-print," must be as short as possible to avoid user dissatisfaction. Thus, especially in B-size and larger printers, it is desirable to rapidly communicate liquid from the reservoir to the wick upon insertion of the cartridge to minimize the time-to-first-print. Also, where an oil is used as the liquid for the intermediate transfer layer, it is especially important to have a simple and reliable, yet relatively inexpensive supply system that does not leak or erratically dispense the oil.

What is needed is a liquid supply system for an intermediate transfer surface application system that overcomes the drawbacks of previous supply systems. Such a system must speed the initial flow of the liquid from the reservoir to the applicator assembly to minimize the time-to-first-print. At the same time, such a system must simply and reliably deliver a precise amount of liquid to the wick without leaking or generating undesirable pressure in the reservoir or connecting tubing.

SUMMARY OF THE INVENTION

It is an aspect of the present invention to provide a supply system for supplying liquid to an intermediate transfer surface applicator assembly in an imaging apparatus.

It is a feature of the present invention that the supply system includes a reservoir with sufficient capacity to contain and consistently supply the volume of liquid necessary to operate an imaging apparatus that utilizes B-size or larger media.

It is another feature of the present invention that the supply system generates a positive pressure on the reservoir when the supply system is initially activated, the supply system thereby speeding transfer of the liquid from the reservoir to the applicator assembly to minimize delays.

It is an advantage of the present invention that the supply system reduces the pressure exerted on the reservoir after the wick in the applicator assembly has been initially saturated to reduce the likelihood of leaks at tubing connection points and valve seals, overflow of liquid in the wick channel and other pressure-related problems.

It is another advantage of the present invention that the reservoir is mounted to be stationary within the supply system to avoid the necessity of moving the entire reservoir to generate liquid flow.

To achieve the foregoing and other aspects, features and advantages, and in accordance with the purposes of the present invention as described herein, an improved supply system for supplying liquid to an applicator assembly in an imaging apparatus is provided. The supply system includes a liquid retaining reservoir that is in fluid communication with an applicator assembly. The reservoir utilizes a collapsible bellows construction to contain a maximum volume of liquid in minimal space. A moveable contact surface contacts and squeezes the reservoir to speed flow of the liquid to the applicator assembly.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
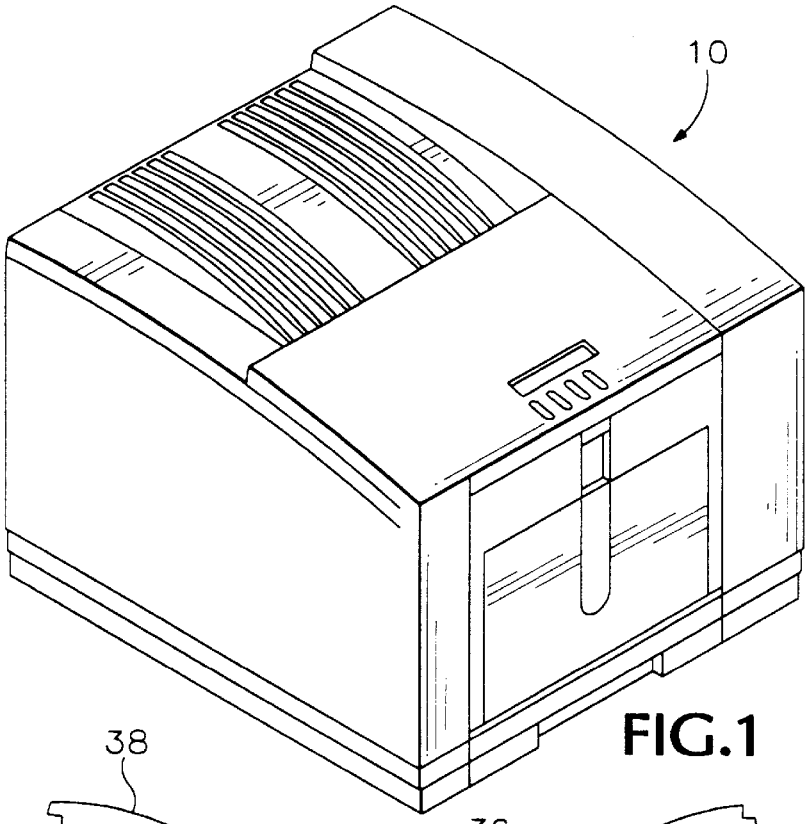
FIG. 1 is an overall perspective view of an offset ink-jet printer that utilizes the supply system of the present invention.

FIG. 1 is an overall illustration of an offset ink-jet printing apparatus, generally indicated by the reference numeral 10, that utilizes the supply system of the present invention. As referenced above, the supply system of the present invention is utilized to deliver liquid to an applicator assembly that applies the liquid as an intermediate transfer surface to the supporting surface of a transfer drum. An example of this type of imaging technology is disclosed in U.S. Pat. No. 5,389,958 entitled IMAGING PROCESS and assigned to the assignee of the present application. The '958 patent is hereby specifically incorporated by reference in pertinent part.

The following description of a preferred embodiment of the supply system of the present invention refers to its use in the type of printing apparatus described in the '958 patent. It will be appreciated, however, that the supply system may be used with various other imaging and printing apparatus that utilize different imaging technologies and/or architectures and require a continuing supply of liquid. Accordingly, the following description will be regarded as merely illustrative of one embodiment of the present invention.

Figure 2:
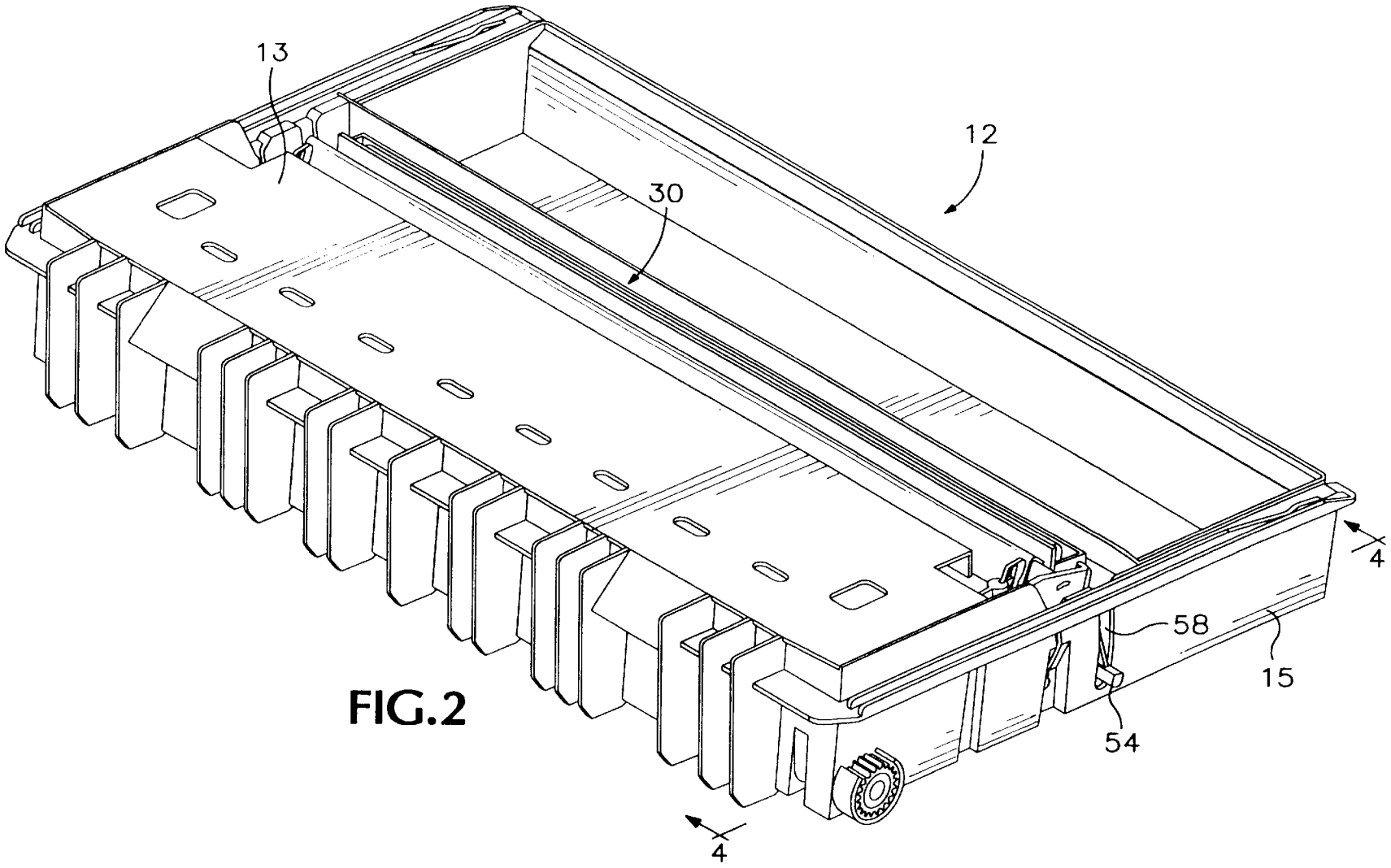
FIG. 2 is an overall perspective view of a replaceable drum maintenance cartridge that incorporates the supply system of the present invention.

FIG. 2 illustrates a replaceable drum maintenance cartridge 12 that utilizes the supply system of the present invention to deliver liquid to an applicator assembly within the cartridge. A representative applicator assembly that may be utilized with the supply system of the present invention is disclosed in copending U.S. patent application Ser. No. 08/382,453, assigned to the assignee of the present application. The '453 application is hereby specifically incorporated by reference in pertinent part.

Figure 3:
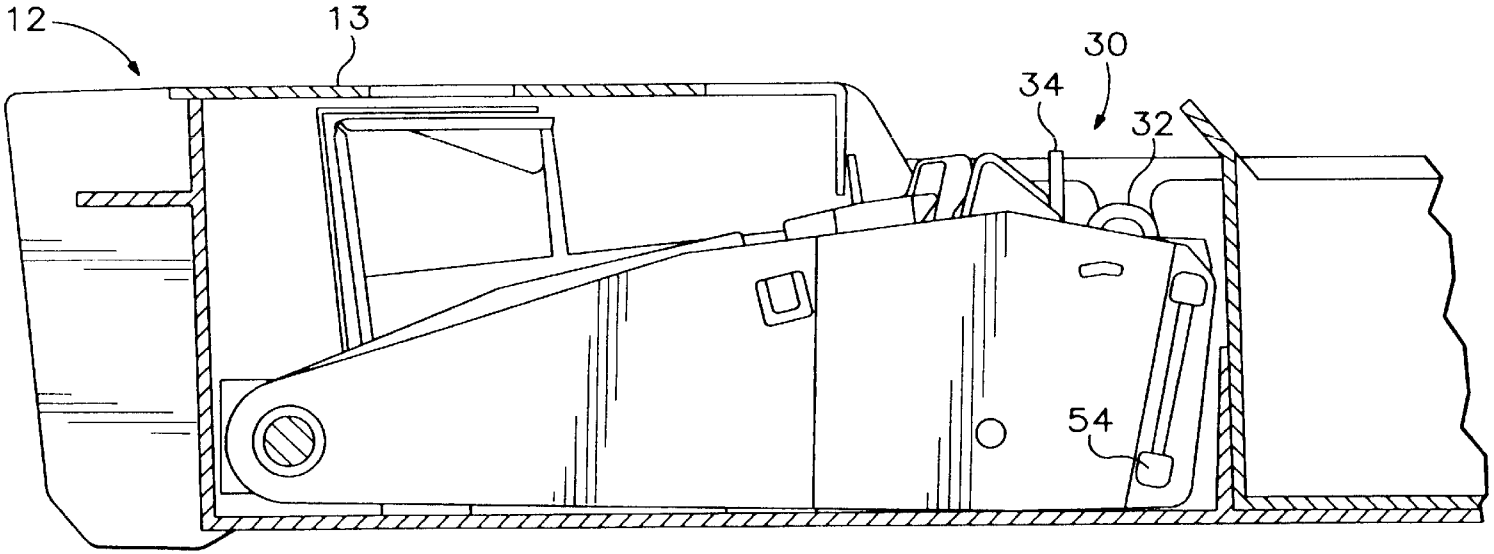
FIG. 3 is a side view in partial cross section of the drum maintenance cartridge showing the applicator assembly in a first "ship" position.

With reference to FIG. 2, the supply system of the present invention is located beneath a cover plate 13 and is not visible in this view. Referring also to FIG. 3, the cartridge 12 also includes an elevatable applicator assembly, generally indicated by the reference numeral 30. As explained more fully below, the applicator assembly 30 selectively applies a liquid intermediate transfer surface to a transfer drum support surface 82 (see briefly FIG. 9).

The liquid intermediate transfer surface receives an ink image from the print head of the printer 10. The liquid transfer surface is a sacrificial layer on the supporting surface 82 of the transfer drum which can be at least partially transferred with the ink image to the final receiving print medium. The liquid layer is replenishable on the supporting surface 82 for subsequent images. Suitable liquids that may be applied to the support surface 82 of the transfer drum as the liquid layer or intermediate transfer surface include water, fluorinated oils, glycol, surfactants, mineral oil, silicone oil, functional oils and combinations thereof. Functional oils can include, but are not limited to, mercapto-silicone oils, fluorinated silicone oils and the like. The preferred liquid is silicone oil. The final print medium may be a transparency, paper or other suitable media.

Figure 4:
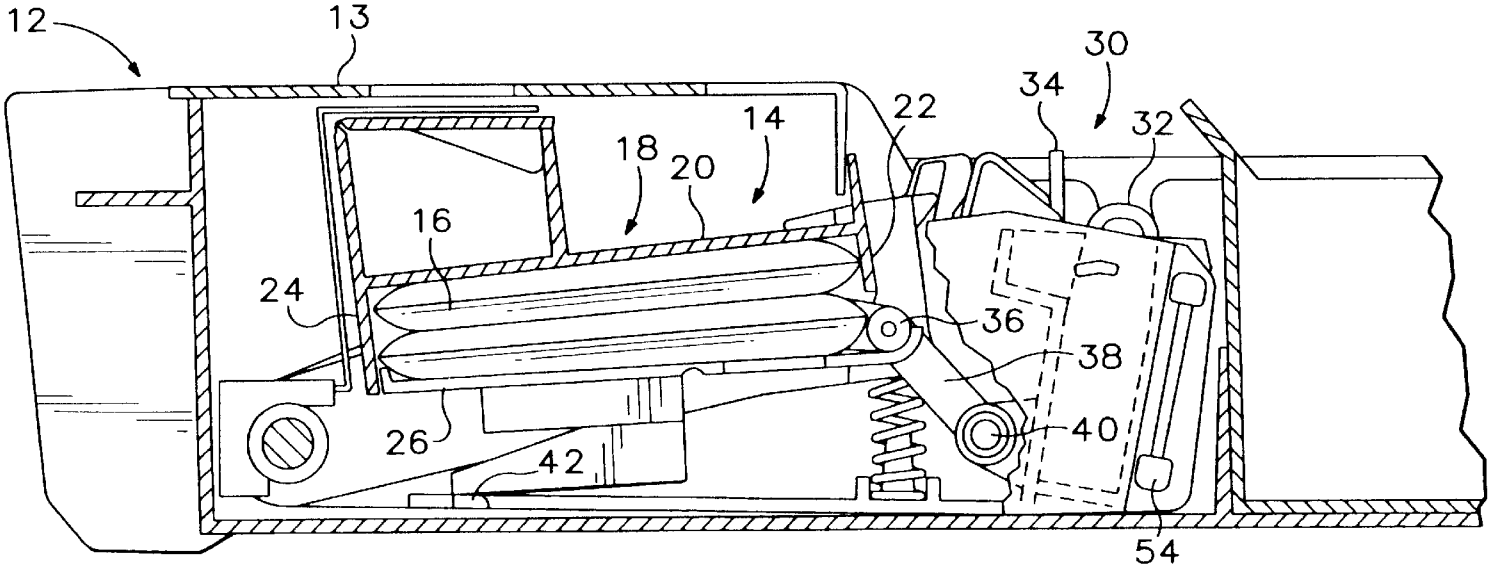
FIG. 4 is a side view in partial cross section of the first "ship" position showing the relative positioning of the supply system and the applicator assembly in the drum maintenance cartridge as viewed along the lines 4—4 in FIG. 2.

With reference now to FIGS. 3 and 4 of the present application, a side view of the drum maintenance cartridge 12 in a first, "ship" position is provided. The supply system of the present invention, generally indicated by the reference numeral 14, includes a liquid retaining reservoir 16 that is contained within a housing 18. In the preferred embodiment, partially illustrated in FIG. 5, the supply system 14 utilizes two identical liquid retaining reservoirs 16, 16' disposed laterally to one another. It will be appreciated that the following discussion of one liquid retaining reservoir 16 applies equally to both reservoirs 16, 16'.

As shown in FIG. 4, the housing 18 includes a ceiling 20, a front retaining wall 22 and a rear retaining wall 24 that substantially enclose the liquid retaining reservoir 16 on three sides. In the preferred embodiment of the present invention described in more detail below, the liquid retaining reservoir 16 is supported from below by a moveable contact surface, preferably a pivoting flange 26, that is opposably spaced from the ceiling 20.

The liquid retaining reservoir 16 is in fluid communication with a contact medium in the form of a wick 32 in the elevatable applicator assembly 30. The wick 32 is selectively raised to contact the transfer drum surface 82 (see briefly FIG. 9) and to simultaneously apply the liquid to and remove foreign matter from the transfer drum surface. The applicator assembly 30 also includes a metering blade 34 that distributes the liquid across the surface 82 of the transfer drum to consistently provide a uniform liquid layer on the drum surface. As best seen in FIGS. 2 and 3, an elevation bar 54 extends laterally from a lower portion of the applicator assembly 30 and through a slot in the sidewall 15 of the cartridge 12 to provide a contact point for raising the assembly, as will be described in further detail below.

Figure 5:
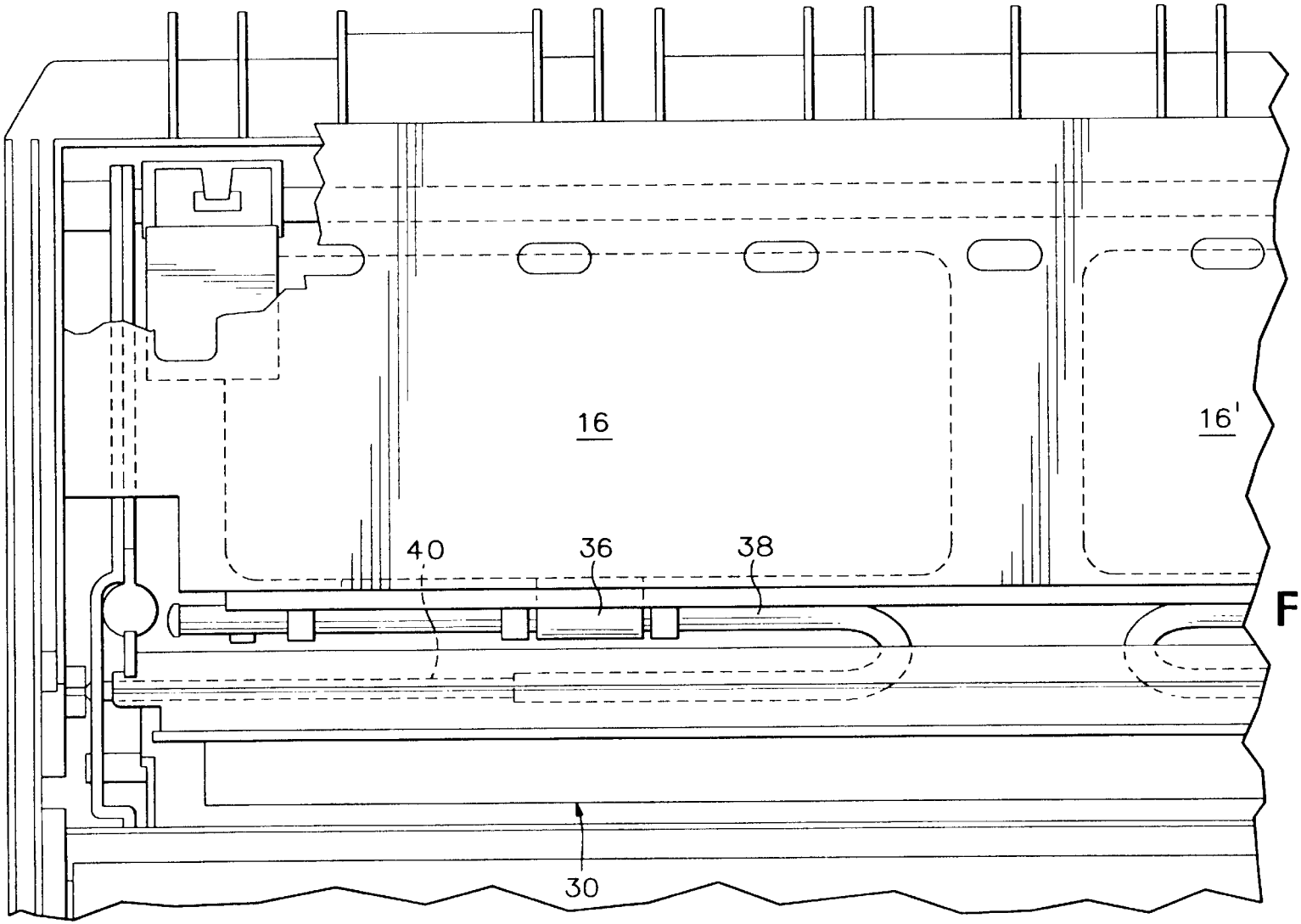
FIG. 5 is a partial top plan view of the drum maintenance cartridge showing in phantom the positioning of two liquid retaining reservoirs within the cartridge.

As shown in FIGS. 4 and 5, an outlet port 36 and flow tube 38 connect the reservoir 16 to the applicator assembly 30. The flow tube 38 is secured to a valve 40 that controls the flow of liquid from the reservoir 16 into the applicator assembly 30. A more detailed discussion of the operation of the valve 40 is provided in the above-referenced copending application Ser. No. 08/382,453 which is specifically incorporated by reference.

With reference now to the present application, operation of the supply system 14 and the applicator assembly 30 is illustrated in varying views in FIGS. 3, 4, 8*a* and 9. As shown in FIGS. 3 and 4, the applicator assembly 30 and supply system 14 are in a first, fully lowered "ship" position when the cartridge 12 is not installed in a printer, such as during shipping or storage. In this position, the valve 40 is closed and no oil is allowed to flow into the applicator assembly 30.

Figure 8:
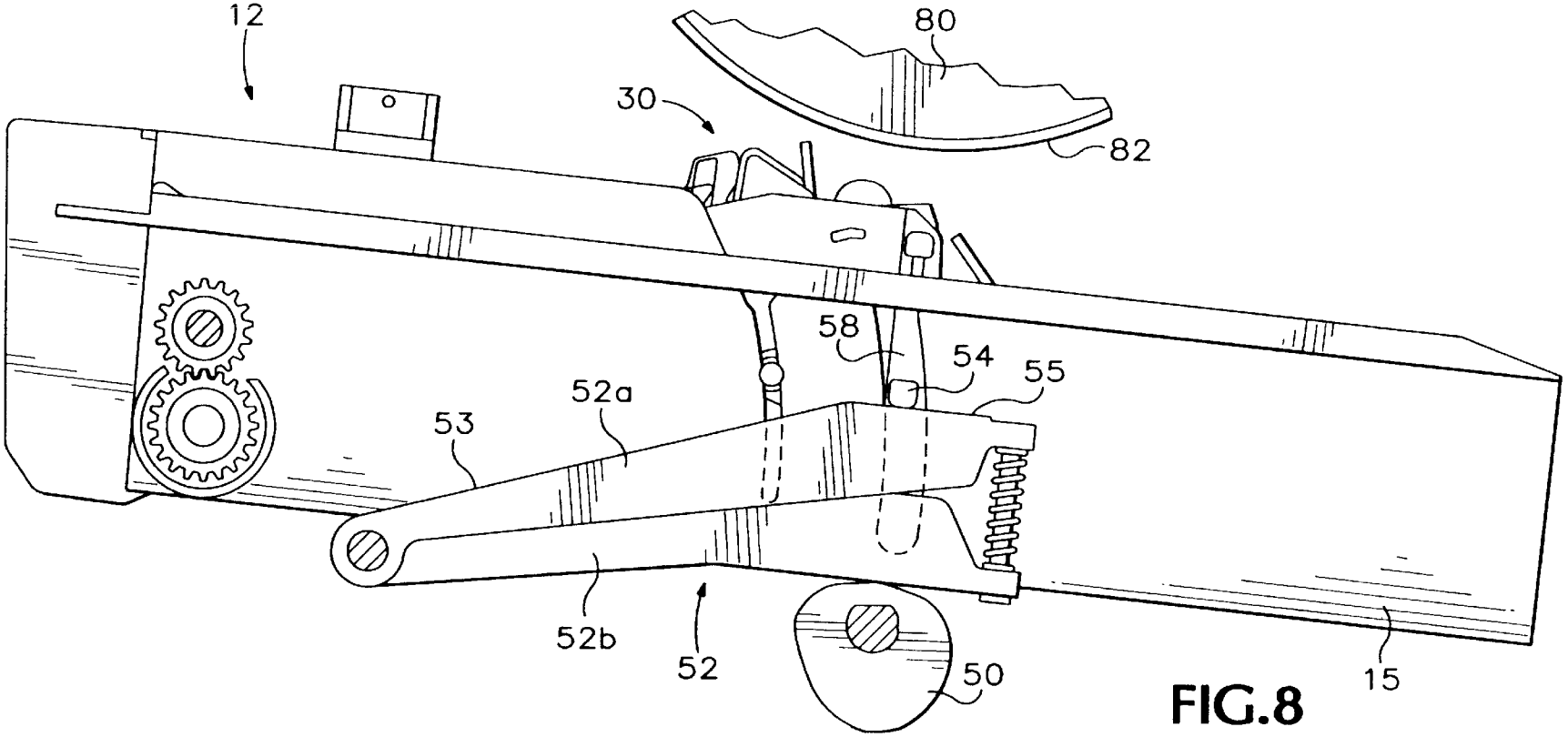
FIG. 8 is a side view of the drum maintenance cartridge in a second, partially raised "park" position showing a cam and cam follower in the imaging apparatus engaging an elevation bar affixed to the applicator assembly and protruding from the side of the drum maintenance cartridge.
Figure 8A:
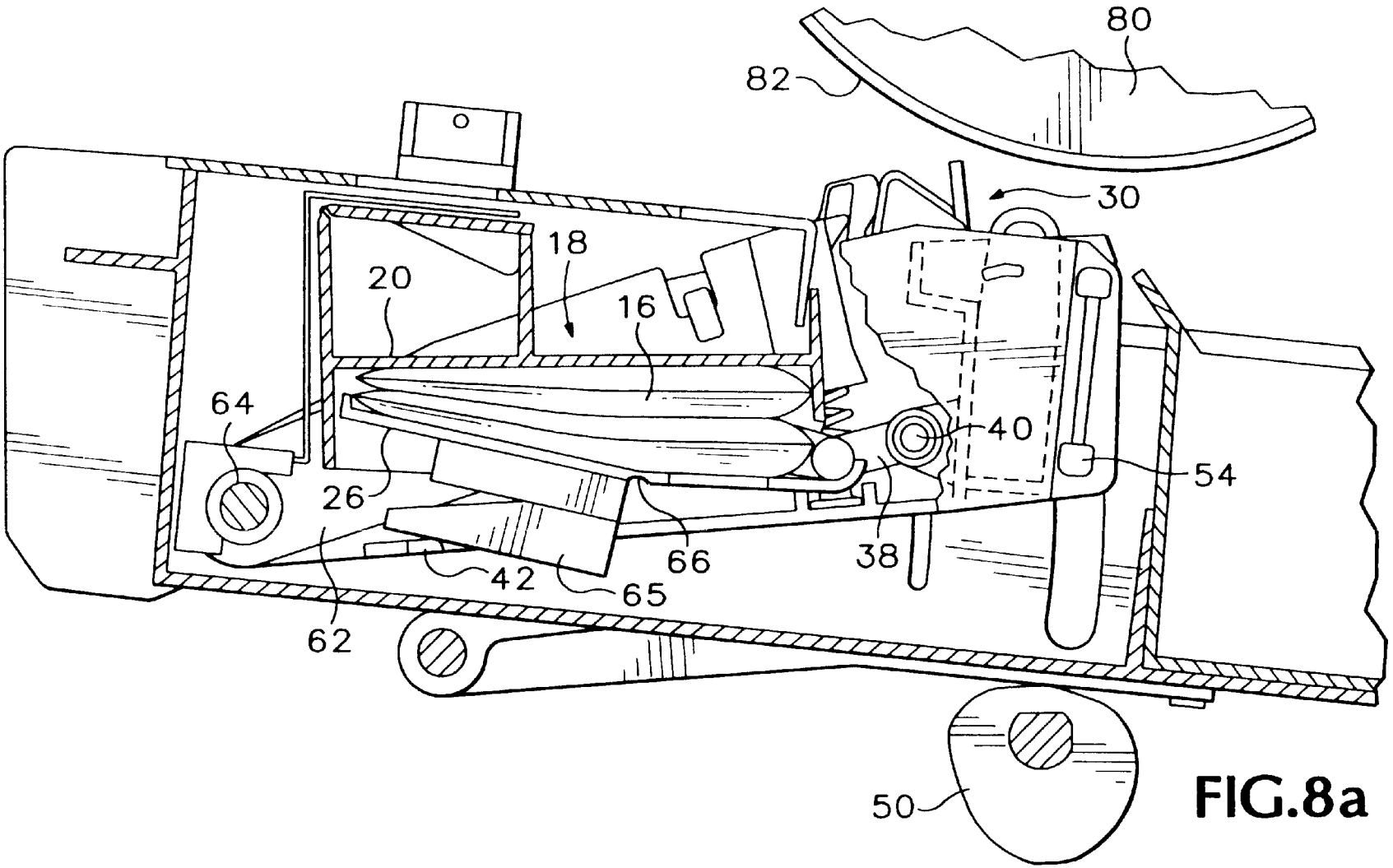
FIG. 8*a* is a side view of the supply system and applicator assembly in the "park" position as viewed along the lines 4—4 in FIG. 2.

With reference now to FIG. 8, as the cartridge 12 is inserted into a printer 10, the elevation bar 54 of the applicator assembly 30 slides along an upper surface 53 of an upper arm 52*a* of a cam follower 52 within the printer until the elevation bar reaches a leveled surface 55. The upward inclination of the upper surface 53 of the upper arm 52*a* causes the elevation bar 54 to rise within the slotted groove 58 in the sidewall 15 of the cartridge 12. This in turn lifts the applicator assembly 30 into a second, "park" position as shown in FIG. 8*a*. The movement of the applicator assembly 30 to this position also causes the valve 40 to open which allows oil to flow from the reservoir 16 to the wick 32. It will be appreciated that a second cam follower and elevation bar (not shown) are present on the other side of the cartridge 12 and interact in the same manner.

With reference now to FIG. 8*a*, in an important aspect of the present invention, the movement of the elevation bar 54 and the applicator assembly 30 upwardly simultaneously causes the pivoting flange 26 to pivot upwardly and squeeze the reservoir 16 between the moveable contact surface and the ceiling 20. The applicator assembly 30 is supported on a pivot arm 62 that pivots about a shaft 64. As the applicator assembly 30 is moved upwardly, a lift tab 42 on the pivot arm 62 engages and lifts a base member 65 that is affixed to the pivoting flange 26, thereby causing the flange 26 to pivot upwardly about a notch 66. Advantageously, by compressing the reservoir 16 in this manner upon initial installation of the cartridge 12 in a printer, the flow of oil from the reservoir to the wick 32 in the applicator assembly 30 is accelerated by creating a positive pressure within the reservoir. This reduces the required delay before printing is enabled, or time-to-first-print, by more efficiently causing the wick 32 to become saturated with oil.

Figure 6:
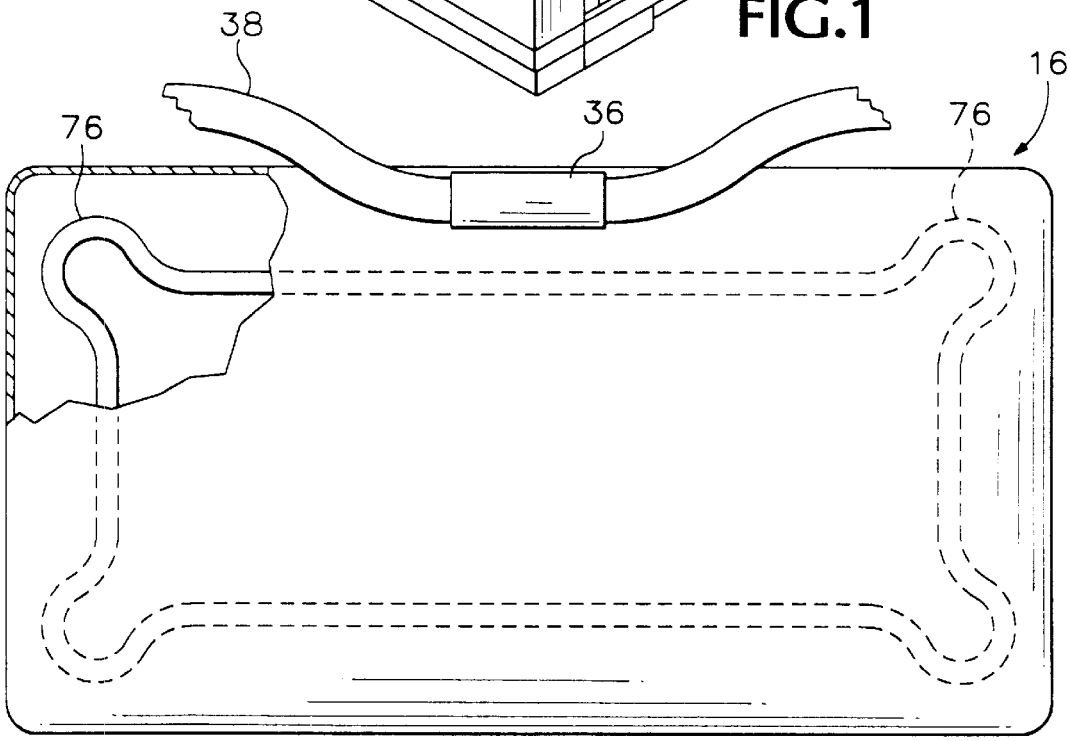
FIG. 6 is a top plan view of one of the liquid retaining reservoirs with a portion of the reservoir broken away to show a u-shaped protrusion in the folding wall of the reservoir.
Figure 7:
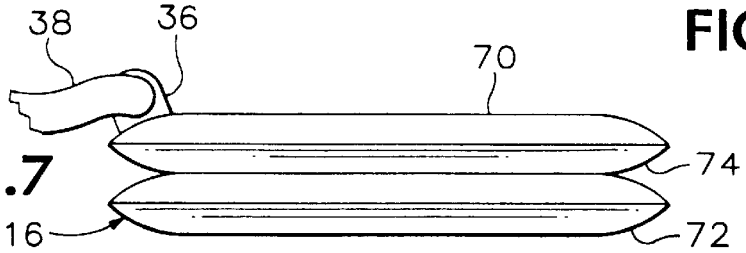
FIG. 7 is a side view of the reservoir showing the collapsible bellows construction.

With reference now to FIGS. 6 and 7, the preferred embodiment of the liquid retaining reservoir 16 will now be discussed. To maximize the volummetric capacity of the reservoir 16 without negatively impacting its manufacturability or performance characteristics, the reservoir 16 incorporates a collapsible bellows construction. More specifically, as shown in FIG. 7, the reservoir includes an upper surface 70 and a lower surface 72 that are connected around their entire periphery by a substantially v-shaped folding wall 74. With reference now to FIG. 6, it will be seen that at each of the four corners of the reservoir 16, the folding wall 74 includes a u-shaped protrusion 76. Advantageously, incorporating these u-shaped protrusions 76 into the reservoir 16 increases the capacity of the reservoir without increasing the volummetric footprint of the reservoir within the housing 18. Further, the u-shaped protrusions 76 allow for this additional capacity without creating unwanted additional pressure within the reservoir 16.

The reservoir 16 is preferably made of about a 5 mil thick polyurethane plastic or other suitable collapsible material. The collapsing of the reservoir 16 as the oil leaves evacuates the interior without creating a negative pressure that would draw air back inside in place of the oil, hindering and eventually stopping the flow of oil out to the applicator assembly 30. Additionally, to eliminate unpredictable pressure in the reservoir 16 due to outgassing during shipment, prior to filling the reservoir the oil is "pre-outgassed" by exposing the oil to very low pressure.

Figure 9:
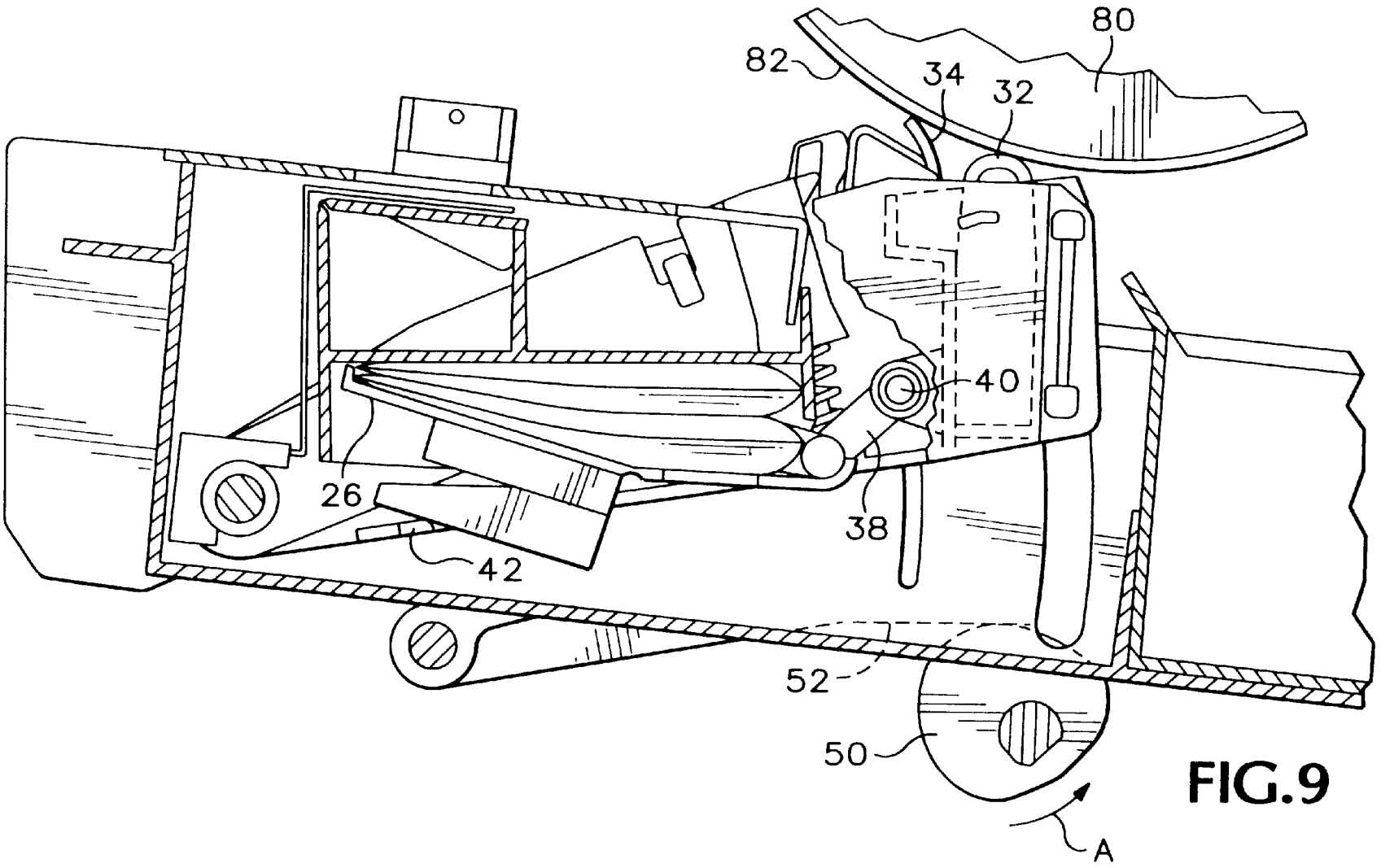
FIG. 9 is a side view in partial cross section of the supply system and applicator assembly in a third, fully raised "apply" position with the wick and metering blade in contact with the transfer drum.

In the preferred embodiment, after the cartridge 12 is inserted in a printer 10 and the applicator assembly 30 reaches the "park" position, the pivoting flange 26 is repeatedly cycled upwardly a predetermined number of times to apply pressure pulses to the reservoir 16 and further encourage the oil to travel from the reservoir to the wick 32. With reference now to FIGS. 8 and 9, this is accomplished by continuously rotating the cam 50 360° in the direction of action arrow A to raise and then lower the cam follower 52 and the elevation bar 54 and attached applicator assembly 30. As shown in FIG. 9, at the uppermost portion of each cycle the applicator assembly 30 reaches a third, "apply" position in which both the wick 32 and the metering blade 34 are in contact with the supporting surface 82.

After the cam 50 is rotated a predetermined number of times, the applicator assembly 30 is maintained in the second, "park" position until the wick 32 is adequately impregnated with oil. At this point, the applicator assembly 30 is raised to the "apply" position to permit a layer of oil to be applied to the transfer drum surface 82.

In the "apply" position the pivoting flange 26 is elevated slightly from the "park" position. However, as noted above, after the initial impregnation of oil into the wick 32, the pressure in the reservoir 16 is substantially zero. Thus, this small additional compression of the reservoir 16 does not create any appreciable increase in pressure within the reservoir. In this manner, the supply system 14 of the present invention selectively generates additional pressure within the reservoir 16 only upon initial installation of the cartridge 12 in a printer 10 to accelerate the impregnation of the wick 32. It follows that for the majority of the lifetime of the cartridge 12 the pressure within the supply system 14 is substantially zero. This advantageously reduces the possibility of oil overflow to the wick 32 and/or oil containment failures or leaks at tubing connections and valve seals.

While the invention has been described above with reference to specific embodiments thereof, it is apparent that many changes, modifications and variations in the materials, arrangements of parts and steps can be made without departing from the inventive concept disclosed herein. For example, an alternative moving means for moving the pivoting flange 26 and applicator assembly 30 could be employed, such as the use of a solenoid or lead screw. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A supply system for supplying liquid to an applicator assembly, the applicator assembly applying a liquid layer to a support surface in an imaging apparatus, the supply system comprising:

a housing having a ceiling;

a pivoting flange adjacent to the housing and opposably spaced from the housing ceiling;

at least one liquid retaining reservoir positioned between the housing ceiling and the pivoting flange, the liquid retaining reservoir in fluid communication with the applicator assembly; and a lift tab that engages the pivoting flange and moves the pivoting flange toward the housing ceiling to squeeze the at least one liquid retaining reservoir between the contact surface and the ceiling, whereby liquid in the reservoir is encouraged to flow from the reservoir to the applicator assembly.

2. The supply system according to claim 1, wherein the lift tab moves in conjunction with an elevation bar.

3. The supply system according to claim 2, wherein the elevation bar is moved by a cam follower in the imaging apparatus.

4. The supply system according to claim 1, wherein the housing comprises an elongated and substantially rectangle trough.

5. The supply system according to claim 1, wherein the liquid retaining reservoir has a collapsible bellows construction.

6. The supply system according to claim 5, wherein the liquid retaining reservoir includes an upper surface and a lower surface that are connected by a folding wall.

7. The supply system according to claim 6, wherein the folding wall is substantially v-shaped.

8. The supply system according to claim 7, wherein the upper surface and the lower surface of the liquid retaining reservoir are substantially rectangular and include four corners.

9. The supply system according to claim 8, wherein the folding wall includes a u-shaped protrusion at each of the four corners of the upper and lower surfaces of the liquid retaining reservoir.

10. The supply system according to claim 9, wherein the reservoir is comprised of polyurethane.

11. The supply system according to claim 1, further comprising the liquid retained in the reservoir being selected from the group consisting of water, fluorinated oils, glycol, surfactants, mineral oil, silicone oil, functional oils and combinations thereof.

12. The supply system according to claim 11, further comprising the liquid retained in the reservoir being an oil.

13. The supply system according to claim 12, further comprising the liquid retained in the reservoir being silicone oil.

14. The supply system according to claim 13, wherein the imaging apparatus comprises a printer.

15. The supply system according to claim 14, wherein the printer further comprises an ink-jet printer.

16. The supply system according to claim 15, wherein the ink-jet printer further comprises a solid ink-jet printer.

* * * * *